US011680214B2

(12) United States Patent
Boumendjel et al.

(10) Patent No.: US 11,680,214 B2
(45) Date of Patent: Jun. 20, 2023

(54) HAZY-FREE AT 0° C HEAVY BASE OIL AND A PROCESS FOR PRODUCING

(71) Applicant: SHELL OIL COMPANY, Houston, TX (US)

(72) Inventors: Nariman Boumendjel, Amsterdam (NL); Ralf Gunnar Meister, Amsterdam (NL); Cornelis Hyacinthus Maria Van Der Hulst, Amsterdam (NL); Nicolaas Van Dijk, Amsterdam (NL)

(73) Assignee: SHELL USA, INC., Houston, TX (US)

( * ) Notice: Subject to any disclaimer, the term of this patent is extended or adjusted under 35 U.S.C. 154(b) by 62 days.

(21) Appl. No.: 17/277,646

(22) PCT Filed: Aug. 28, 2019

(86) PCT No.: PCT/EP2019/072979
§ 371 (c)(1),
(2) Date: Mar. 18, 2021

(87) PCT Pub. No.: WO2020/043783
PCT Pub. Date: Mar. 5, 2020

(65) Prior Publication Data

US 2022/0025278 A1 Jan. 27, 2022

Related U.S. Application Data

(60) Provisional application No. 62/724,901, filed on Aug. 30, 2018.

(51) Int. Cl.
*C10G 65/12* (2006.01)
*C10M 101/02* (2006.01)
(Continued)

(52) U.S. Cl.
CPC ..... *C10G 65/12* (2013.01); *C10M 101/02* (2013.01); *C10G 2300/1074* (2013.01);
(Continued)

(58) Field of Classification Search
CPC ..... C10G 65/12; C10G 2300/1074; C10G 2300/202; C10G 2300/205;
(Continued)

(56) References Cited

U.S. PATENT DOCUMENTS 4,916,096 A 4/1990 Hoek et al.
4,925,820 A 5/1990 Hoek et al.
(Continued)

FOREIGN PATENT DOCUMENTS

CA 2682660 A1 * 10/2008 ..... C10M 101/02
WO 2004047988 A1 6/2004
WO 2017109179 A1 6/2017

OTHER PUBLICATIONS

International Search Report and Written Opinion received for PCT Patent Application No. PCT/EP2019/072979, dated Oct. 9, 2019, 10 pages.

*Primary Examiner* — Randy Boyer
*Assistant Examiner* — Juan C Valencia
(74) *Attorney, Agent, or Firm* — Shell USA, Inc.

(57) ABSTRACT

A process for producing a base oil composition from a deasphalted oil (DAO) feed, where the DAO feed undergoes hydrotreating, hydrocracking, catalytically dewaxing, hydrofinishing, and fractionating to generate the base oil composition. The base oil composition includes a hazy-free at 0° C. heavy base oil comprising (a) a kinetic viscosity ranging from 15 to 21 cSt at 100° C., (b) a 5 viscosity index of at least 95, (c) a pour point of less than −12° C., (d) a cloud point of less than −18° C., and (e) a total aromatics content of 2 wt % or less, where the hazy-free at 0° C. heavy
(Continued)

base oil maintains a hazy-free appearance when stored undisturbed at 0° C. during a test period.

29 Claims, 1 Drawing Sheet

(51) Int. Cl.
*C10N 20/00* (2006.01)
*C10N 30/00* (2006.01)
*C10N 20/02* (2006.01)

(52) U.S. Cl.
CPC ..... *C10G 2300/202* (2013.01); *C10G 2300/205* (2013.01); *C10G 2300/206* (2013.01); *C10G 2300/301* (2013.01); *C10G 2300/302* (2013.01); *C10G 2300/304* (2013.01); *C10G 2300/308* (2013.01); *C10G 2300/4006* (2013.01); *C10G 2300/4012* (2013.01); *C10G 2300/4018* (2013.01); *C10G 2300/70* (2013.01); *C10G 2400/10* (2013.01); *C10M 2203/1006* (2013.01); *C10N 2020/011* (2020.05); *C10N 2020/02* (2013.01); *C10N 2030/43* (2020.05)

(58) Field of Classification Search
CPC ..... C10G 2300/206; C10G 2300/301; C10G 2300/302; C10G 2300/304; C10G 2300/308; C10G 2300/4006; C10G 2300/4012; C10G 2300/4018; C10G 2300/70; C10G 2400/10; C10M 101/02; C10M 2203/1006; C10M 171/00; C10N 2020/011; C10N 2020/02; C10N 2030/43
See application file for complete search history.

(56) References Cited

U.S. PATENT DOCUMENTS

| | | | | |
|---|---|---|---|---|
| 5,358,627 | A * | 10/1994 | Mears | C10G 65/12 208/100 |
| 7,737,074 | B2 | 6/2010 | Smegal et al. | |
| 9,199,228 | B2 | 12/2015 | Domokos et al. | |
| 9,516,029 | B2 | 12/2016 | Das et al. | |
| 9,586,499 | B2 | 3/2017 | Fushimi et al. | |
| 2007/0158237 | A1* | 7/2007 | Adams | C10M 105/04 208/18 |
| 2010/0187155 | A1 | 7/2010 | McCarthy et al. | |
| 2010/0236988 | A1 | 9/2010 | Gabrielov et al. | |
| 2011/0315596 | A1 | 12/2011 | Prentice et al. | |
| 2015/0060329 | A1 | 3/2015 | Wedlock | |
| 2017/0183575 | A1* | 6/2017 | Rubin-Pitel | C10G 67/049 |

* cited by examiner

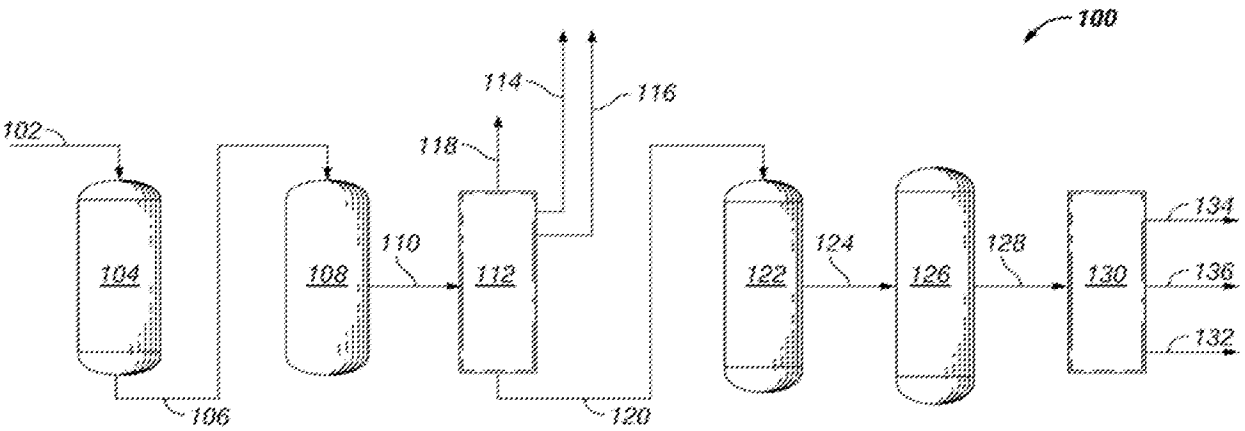
100
102
104
106
108
110
112
114
116
118
120
122
124
126
128
130
132
134
136

HAZY-FREE AT 0° C HEAVY BASE OIL AND A PROCESS FOR PRODUCING

CROSS REFERENCE TO RELATED APPLICATIONS

This is a national stage application of International Application No. PCT/EP2019/072979, filed 28 Aug. 2019, which claims benefit of priority to U.S. Provisional Application No. 62/724,901, filed 30 Aug. 2018.

FIELD OF THE INVENTION

The present invention relates to a haze-free at 0° C. heavy base oil and a process for producing the heavy base oil from a deasphalted oil feed.

BACKGROUND OF THE INVENTION

Heavy lubricating base oils used in the formulation of engine lubricants and industrial oils may be prepared from suitable hydrocarbon feeds derived from the deasphalting of atmospheric or vacuum residues. One example of a hydrocarbon feed used to produce heavy base oils includes deasphalted oil (DAO). DAO is typically subjected to several processing steps, for example, hydrotreatment to remove nitrogen, sulfur, metals, and other contaminants and hydrocracking to reduce the molecular weight of aromatic compounds and haze precursors. Hydrotreatment and hydrocracking can also increase the viscosity index and kinetic viscosity of the resulting base oil product.

Although considered a suitable feed due to its high viscosity, DAO is indeed rich in wax compounds that are solid at ambient temperatures and often imparts undesirable high pour and cloud points to the base oil product. Such undesirable properties, among others, can hinder production efforts, use, storage, and transportation of such base oils. Accordingly, additional steps including catalytic dewaxing and hydrofinishing of the DAO can improve cold flow properties and overall product stability by removing wax compounds which decreases the pour point and cloud point of the base oil produced thereafter.

However, even after catalytically dewaxing a DAO feed, the base oil product may still contain naturally-occurring haze precursors, e.g., paraffin-like wax compounds and other wax compounds. If present in sufficient quantities, the haze precursors form a visual haze in the base oil at ambient temperatures, particularly, if the base oil is allowed to stand at low temperatures for an extended period of time. The visual haze manifests as a milky or cloudy appearance that contributes to degraded visual quality and undesirable performance of base oil products at low temperature conditions. Haze precursors may also affect the filterability of the base oil or the finished lubricant containing the base oil.

The DAO feed may therefore be subjected to hydrotreatments to initially remove contaminants such as nitrogen, and thereafter additional dewaxing and distillation steps to remove the wax compounds. Yet, additional and/or more severe process steps may lower product yields and, as a consequence, substantially reduce the ratio of heavy base oils over light base oils. A reduction in the heavy base oil yield is often undesirable during periods of high demand for such oils.

Accordingly, there is a continuing need for a base oil composition with improved low cold-flow properties and sustained use during low temperature applications and a process for producing thereof that provides for maximum production yields.

SUMMARY OF THE INVENTION

The present invention provides a haze-free 0° C. heavy base oil and a process for producing thereof. The process comprises providing a deasphalted oil (DAO) feed which contains at least 50% by weight of hydrocarbons boiling above 450° C., nitrogen in an amount ranging from 400-2500 ppm or more, sulfur in an amount ranging from 0.5-4.0 wt % or more, and a (nickel (Ni)+vanadium (V)) metal content in an amount ranging from 2-250 ppmw. A portion of the DAO feed is hydrotreated in the presence of hydrotreating catalysts to produce a hydrotreated product which contains nitrogen in an amount ranging from 0.1-30 ppmw, sulfur in an amount ranging from 10-200 ppmw, and a total uptake of at least 30% of the (Ni+V) metal content. The hydrotreated product is hydrocracked in the presence of hydrocracking catalysts to produce a hydrocracked product that is fractionated into light distillates, middle distillates, and hydrowax. The hydrowax is catalytically dewaxed in the presence of noble metal-based catalysts to produce a dewaxed product. The dewaxed product is hydrofinished in the presence of hydrofinishing catalysts to produce a hydrofinished product. The hydrofinished product is fractionated to yield at least one fraction comprising the haze-free at 0° C. heavy base oil which can maintain a hazy-free appearance when stored undisturbed at 0° C. during a test period of at least 5 hours, preferably at least 7 hours. The fractionated haze-free at 0° C. heavy base oil that is recovered is a Group II/III base oil that maintains a hazy-free appearance when stored undisturbed at 0° C. during a test period.

The haze-free 0° C. heavy base oil of the present invention comprises a kinetic viscosity ranging from 15 to 21 cSt at 100° C., a viscosity index ranging from 95 to above 120, a pour point of less than −12° C., a cloud point of less than −18° C., and a total aromatics content of 2 wt % or less.

DESCRIPTION OF THE DRAWINGS

Certain exemplary embodiments are described in the following detailed description and in reference to the drawing, in which:

FIGURE illustrates an example embodiment of a flow process for producing a haze-free at 0° C. heavy base oil from a deasphalted (DAO) feed.

DETAILED DESCRIPTION OF THE INVENTION

The present invention discloses a hazy-free at 0° C. heavy base oil composition and a process for producing thereof. The process includes hydrotreating, hydrocracking, catalytic dewaxing, and hydrofinishing a DAO feed, in the presence of noble metal and metal-based catalysts, to produce the haze-free at 0° C. heavy base oil. The hazy-free at 0° C. heavy base oil comprises a kinetic viscosity ranging from 15 to 21 cSt at 100° C., preferably 19 to 20 cSt at 100° C., and a viscosity index ranging from 95 to 119 when prepared as a Group II base oil and a viscosity index above 120 when prepared as a Group III base oil. Additionally, the hazy-free at 0° C. heavy base oil comprises a pour point of less than −12° C., preferably less than −18° C., and more preferably less than −24° C., a cloud point of less than −18° C., preferably less than −21° C., and a total aromatics content of less than 2 wt %, preferably less than 1 wt %.

The inventive haze-free at 0° C. heavy base oil composition comprises a Group II/III lubricating base oil with improved cold-flow properties, including reduced cloud and pour points. The inventive composition moreover maintains a hazy-free appearance when stored and/or transported at 0° C. without agitation (i.e., in an undisturbed state) during an extended period of time, for example, 5 hours, preferably 7 hours. The inventive composition is therefore desirable for use, storage, and transportation activities during heavy duty, low temperature applications. In addition to improved cold flow properties, the inventive haze-free at 0° C. heavy base oil provides end-product stability properties including a reduction in contaminants (e.g., nitrogen, sulfur, aromatics), the lack of haze formation during cold temperature applications, and a higher viscosity index and kinetic viscosity. The inventive process, which includes the use of metal-based and noble metal-based catalysts, surprisingly produces higher yields of the haze-free at 0° C. heavy base oil over conventional base oil production processes.

DAO Feedstock

The DAO feed is obtained by deasphalting a residual hydrocarbon oil, preferably an atmospheric or vacuum residue fraction. The deasphalting process is well-known in the art and is carried out in any conventional manner known to those skilled in the art. The boiling point range of the DAO feed is about 300° C. to about 1000° C. and contains at least 50% by weight of hydrocarbons having a boiling point above 450° C. Preferably, the DAO feed contains more than 65%, but at least 50%, by weight of hydrocarbons boiling above 450° C.

The DAO feed used during the present embodiments is a pure DAO or a blend of DAO and vacuum gas oil (VGO) in a ratio of about 6:1 to about 1:6. In other embodiments of the invention, the DAO feed is a blend of DAO, VGO, or hydrowax in a combination of two or more thereof. Hydrowax is a paraffinic fraction with a boiling point typically in the range of 280° C. to 900° C. and is obtained in the present embodiments after distillation of a hydrocracked product, as will be later explained herein.

The DAO feed comprises nitrogen, sulfur, and aromatic compounds, along with a metal content (nickel (Ni)+vanadium (V)) ranging from about 2 to about 250 ppm or more. The nitrogen content is at least 400 ppm or more based on the total weight of the DAO feed on residue. The sulfur content is 0.5 weight % (wt %) or more, based on the total weight of the DAO feed on residue. The aromatics content of the DAO feed ranges from at least 20 wt % to 90 wt %, more specifically from at least 30 wt % to 70 wt %, and can include monoaromatic, diaromatic, and/or polycyclic aromatic contents.

The DAO feed also comprises a wax content ranging up to 40 wt %. Therefore, using DAO as a feed often produces a base oil with unacceptable haze-precursors and haze-forming levels and tendencies. The DAO feed described herein is, thus, subjected to hydrotreating, hydrocracking, catalytic dewaxing, and hydrofinishing steps, among other processing steps, in the presence of metal-based and noble metal-based catalysts to produce the inventive haze-free at 0° C. heavy base oil.

Hydrotreating

The DAO feed is provided at step (a), for example, from a storage tank, separator, or any type of containment vessel as known. During hydrotreating at step (b), a portion of the DAO feed is contacted with hydrogen, in the presence of a hydrotreating catalyst system within a reactor, to produce a hydrotreated product. Preferably, the hydrotreated product is a heavy feed with an initial boiling point greater than about 300° C. and an end boiling point less than about 700° C. It is also preferred that at least 90 wt % of the hydrotreated product have a boiling temperature above 570° C., and that at least 95 wt % of the hydrotreated product have a boiling temperature above 595° C. The hydrotreated product comprises a reduced nitrogen content ranging from about 0.1 to about 30 ppm and a reduced sulfur content ranging from 10 to 200 ppm upon completion of hydrotreating step (b).

The hydrotreating catalyst system includes a combination of suitable catalysts for the reduction and/or removal of metals, nitrogen, sulfur, and aromatics, among other contaminants, from the DAO feed. The hydrotreating catalyst system can be configured in any suitable configuration within the reactor. In preferred embodiments, the hydrotreating catalyst system includes at least one hydrodemetallization catalyst and at least one hydrotreating catalyst. More preferably, the DAO feed is initially exposed to the at least one hydrodemetallization catalyst for the metal uptake of nickel (Ni) and vanadium (V) prior to exposing the DAO feed to the hydrotreating catalyst. Prior exposure to the hydrodemetallization catalyst can reduce or minimize the deactivation of the hydrotreating catalysts and/or other subsequent catalysts used during the remaining process steps.

Commercially available bimodal hydrodemetallization catalysts including a metal hydrogenation component, suitably Group IVB or VIII metals (e.g., nickel-molybdenum, cobalt-molybdenum), on a porous support (e.g., silica-alumina or alumina) are used to provide a total uptake of at least 30 wt % of the of Ni—V metal concentration within the DAO feed. After metal uptake, the DAO feed is exposed to the at least one suitable hydrotreating catalyst.

Preferably, the hydrotreating catalyst can include a support material loaded with catalytically active metal compounds, an amine compound, and a non-amine containing polar additive as described in U.S. Pat. Nos. 9,516,029 and 9,586,499, which are herein incorporated by reference. The support material of the hydrotreating catalyst comprises any suitable inorganic oxide material typically used to carry catalytically active metal components. Examples of possible inorganic oxide materials include alumina, silica, silica-alumina, magnesia, zirconia, boria, titania and mixtures of any two or more of such inorganic oxides. The preferred inorganic oxides for use in the formation of the support material are alumina, silica, silica-alumina and mixtures thereof. Most preferred, however, is alumina.

The catalytically active metal compounds are selected from Group VI metals (e.g., chromium (Cr), molybdenum (Mo), and tungsten (W)) and Groups IX and Group X metals (e.g., cobalt (Co) and nickel (Ni)). Phosphorous (P) is also a desired metal component. For the Group VI metals, metal salts include Group VI metal oxides or sulfides. Preferred are metal salts of the Group VI metals include ammonium heptamolybdate and ammonium dimolybdate. For the Group IX and X metals, metal salts include Group IX or X metal acetates, formats, citrates, oxides, hydroxides, carbonates, nitrates, sulfates, and two or more thereof. Preferred metal salts are metal nitrates, for example, such as nitrates of nickel or cobalt, or both.

The weight percentage of the catalytically active metal compound incorporated into the support material depends upon the application. Group VI metals (preferably, molybdenum) range from 5 to 50 wt %, preferably from 8 to 40 wt %, and, most preferably, from 12 to 30 wt % in the support material. The Group IX and X metals (preferably, nickel) range from 0.5 to 20 wt %, preferably from 1 to 15 wt %, and, most preferably, from 2 to 12 wt % in the support material. The above-referenced weight percentages for the metals are based on a dry support material and the metals as elements regardless of the actual form of the metals.

Any suitable amine compound can be used as long as it provides for the desired catalytic properties. As the term is used herein, an amine or amine compound is a molecule having an amino functional group, thus, a nitrogen atom having bonded thereto up to three separate atoms of hydrogen or one, two or three groupings of atoms. Examples of desirable amine components are molecules selected from the group of compounds consisting of ether amine compounds, alkyl or alkenyl amine compounds, or amine oxide compounds.

The non-amine containing polar additives of the hydrotreating catalysts include the polar additive compounds described in U.S. Patent Pub. No. US 2010/0236988 but excluding, however, those polar additive compounds that are heterocompounds having an amino functional group or a sulfur atom.

It is preferred that the relative weight ratio of the non-amine containing polar additive to the amine compound incorporated into the metal-loaded support material be in the range upwardly to 10:1 (10 weight parts non-amine containing polar additive to 1 weight part amine compound), for example, from 0:01 to 10:1. More typically, the weight ratio of the non-amine containing polar additive to amine compound should be in the range of from 0.1:1 to 9:1. Preferably, the weight ratio is in the range of from 0.2:1 to 8:1, more preferably, from 0.2:1 to 7:1, and, most preferably, it is in the range of from 0.25:1 to 6:1.

The combination of an amine component with a non-amine component containing polar additives within a metal-loaded support material provides a hydrotreating catalyst with enhanced catalytic properties over typical compositions that include a support material loaded with an active metal precursor and having either an amine component alone or a non-amine containing polar additive alone. To obtain the beneficial effect of combining an amine component and a non-amine containing polar additive, the relative ratio of these two components incorporated into the support material should be within the ranges as described above.

The hydrotreating conditions implemented at step (b) often depend on the desired level of conversion, the type of catalysts implemented, and the level of contaminants in the DAO feed, among other factors. Suitable reaction temperatures range from 250 to 480° C., preferably from 280 to 450° C., and more preferably from 350° C. to 420° C. Suitable reaction pressures range from 30 to 250 bar. Preferably, the reaction pressure ranges from 110 to 180 bar, and more preferably in the range of from 120 to 170 bar. The liquid hourly space velocity (LHSV) is suitably in the range of from 0.2 to 10 $hr^{-1}$, preferably in the range of from 0.2 to 2.0 $hr^{-1}$, and more preferably in the range of from 0.2 to 1.0 $hr^{-1}$.

Hydrocracking

The hydrotreated product of step (b) is contacted with hydrogen, in the presence of a hydrocracking catalyst system within a reactor at step (c) to produce a hydrocracked product. To retain heaviness, at least 15% to about 20% of the longer chain hydrocarbon molecules of the hydrotreated product boiling at or above 380° C. are converted into components boiling below 380° C. during hydrocracking. The hydrocracking process of the present invention is well-known in the art and includes combining catalytic cracking and hydrogenation steps to break longer chain hydrocarbon molecules and haze precursors into simpler, or short chain, molecules.

The reactor of the present invention is of a suitable configuration, as known to those skilled in the art, and is defined by one or more reactor zones including one or more beds of hydrocracking catalysts. More particularly, the reactor includes a combination of hydrotreating and hydrocracking catalysts configured in a suitable configuration for multi-stage processing, more preferably, at least three-stage processing that includes a first hydrotreating stage, a second hydrocracking stage, and a third hydrotreating stage. The multi-stage processes are not limited to the configuration described herein as those skilled in the art will understand but may include additional or fewer stages in order to accomplish the desired result.

The first and third stages are hydrotreatment stages to reduce and/or remove any remaining nitrogen, sulfur, and unsaturated compounds from the hydrotreated product in the presence of the hydrotreating catalysts. The hydrotreating catalysts used are as previously described with respect to step (b) which includes a support material loaded with catalytically active metal compounds, an amine compound, and a non-amine containing polar additive.

Hydrocracking of the hydrotreated product occurs in the second stage in the presence of a hydrocracking catalyst, as disclosed in U.S. Pat. No. 9,199,228, which is herein incorporated by reference. The hydrocracking catalyst embodies strong cracking function and includes a porous carrier impregnated with a hydrogenation component, suitably Group VIII (preferably, cobalt, nickel, iridium, platinum and/or palladium) and/or Group IVB (preferably molybdenum and/or tungsten) catalytically active metals.

The porous carrier of the hydrocracking catalyst includes an amorphous binder and zeolite Y. The amorphous binder includes any refractory inorganic oxide or mixture of oxides. Generally, this is alumina, silica, silica-alumina or a mixture of two or more thereof. However, it is also possible to use zirconia, clays, aluminum phosphate, magnesia, titania, silica-zirconia and silica-boria. The most preferably amorphous binder is silica-alumina. Amorphous silica-alumina preferably contains silica in an amount ranging from 25% to 95% wt as calculated based on the total carrier weight. More preferably, the amount of silica in the carrier is greater than 35% wt, and most preferably at least 40% wt. A suitable amorphous silica-alumina product for use in preparing the porous carrier of the invention comprises 45% wt silica and 55% wt alumina and is commercially available.

Preferred zeolite Y materials include zeolite Y having a silica to alumina ratio (SAR) of more than 10, especially an ultra-stable zeolite Y (USY) or a very ultra-stable zeolite Y (VUSY) of unit cell size ($a_o$) less than 2.440 nm (24.40 Angstroms), in particular less than 2.435 nm (24.35 Angstroms) and a SAR of more than 10, specifically, more than 10 and up to 100. As used herein, the term SAR references the molar ratio of silica and alumina contained in the framework of a zeolite.

Suitable zeolite Y materials are known and describe, for example, in EP247678, EP247679, and WO2004/047988. Preferred VUSY zeolite of EP247678 or EP247679 is characterized by a unit cell size below 2.445 nm (24.45 Angstroms) or 2.435 nm (24.35 Angstroms), a water adsorption capacity (at 25° C. and a p/po value of 0.2) of at least 8% wt of the zeolite and a pore volume of at least 0.25 mug wherein between 10% and 60% of the total pore volume is made up of pores having a diameter of at least 8 nm. Most preferred are the low unit cell size, high surface area zeolite Y materials described in WO2004/047988. Such materials can be described as a zeolite Y having a SAR above 12, a unit cell size in the range of from 24.10 to 24.40 Å, and a surface area of at least 850 $m^2/g$ as measured by the BET method and ATSM D 4365-95 with nitrogen adsorption at a p/po value of 0.03

While USY and VUSY zeolites are preferred for use in the present invention, other Y zeolite forms are also suitable for use, for example, ultra-hydrophobic Y zeolites.

In other embodiments, the porous carrier of the present invention can include an additional zeolite besides the zeolite Y described above. Preferably, the additional zeolite is selected from zeolite beta, zeolite ZSM-5, or a zeolite Y having a unit cell size and/or SAR other than described above. The additional zeolite preferably is zeolite beta. The additional zeolite can be present in an amount of up to 20% wt, based on the total carrier weight, but preferably the additional zeolite is present in an amount in the range of from 0.5% to 10% wt.

The amount of all zeolites in the porous carrier ranges from 2% to 70% wt based on the total carrier weight with the amount of amorphous binder ranging from 8% to 30% wt. Preferably, the amount of all zeolites in the porous carrier is in the range of from 5% to 50% wt, preferably from 10% to 50% wt based on the total carrier weight.

The hydrogenation component of the hydrocracking catalyst is comprised of Group VIB, preferably, molybdenum and/or tungsten, and Group VIII metals, preferably cobalt, nickel, iridium, platinum and/or palladium, their oxides and sulfides. The hydrocracking catalyst will preferably contain at least two hydrogenation components, more specifically, molybdenum and/or tungsten in combination with cobalt and/or nickel. Preferred combinations are nickel/tungsten and nickel/molybdenum where advantageous results are obtained when these metal combinations are used in the sulfide form. The hydrocracking catalyst according to the present invention may contain up to 50 parts by weight of the hydrogenation component, calculated as metal per 100 parts by weight (dry weight) of total catalyst composition weight. For example, the hydrocracking catalysts can contain from 2 to 40, more preferably from 5 to 30 and especially from 10 to 20, parts by weight of Group VIB metal(s) and/or from 0.05 to 10, preferably from 0.5 to 8, and more preferably from 1 to 6, parts by weight of Group VIB and VIII metal(s), calculated as metal per 100 parts by weight (dry weight) of the total catalyst composition weight.

The hydrocracking catalyst used in the present invention provides improved contaminant removal properties along with improved activity and selectivity where 50% of a total pore volume of the hydrocracking catalyst is present in pores having a diameter in the range of from 4 to 50 nm. The acidity of the hydrocracking catalysts, as measured by exchange with perdeuterated benzene, is 20 micromole/gram or less and thus, has a lower acidity than most known catalysts. The acidity is preferably at most 15, preferably at most 12, more preferably at most 10, and most preferably at most 8 micromole/gram. While reduced acidity conventionally results in reduced hydrocracking activity, the presently described hydrocracking catalysts surprisingly provides increased gas oil selectivity at the same activity.

The hydrocracking process conditions, as described herein, are dependent upon the desired level of conversion, the level of contaminants in the DAO feed, and other factors. Suitable hydrocracking process conditions are known to those skilled in the art. In the embodiments, common hydrocracking conditions include reaction temperatures of 250-500° C., suitably in the range of 350-475° C., reactions pressure of 35-250 bar, suitably in the range of 100-200 bar, and a weight hourly space velocity (WHSV) of 0.2-10 $hr^{-1}$, preferably suitably in the range of 0.5-1.5 $hr^{-1}$. The hydrocracking process conditions also include a weighted average bed temperature (WABT) in the range of from 350-420° C. and a gas to oil ratio in the range of from 500 Nl/kg-1500 Nl/kg.

The hydrocracking reaction conditions are set so as to provide a desired conversion of hydrotreated products with a boiling point at or above 380° C. to lower boiling point products (i.e., below 380° C.). Typically, the targeted conversion is at least 50%. It is preferred that the conversion of the hydrotreated product exceed 60%, and, most preferred, the conversion is greater than 75%.

Distillation System I

The hydrocracked product produced at step (c) can initially pass to a gas-liquid separator before flowing into a distillation unit at step (d). The gas-liquid separator separates the hydrocracked product into a gaseous phase and a liquid phase at process conditions including a temperature ranging from about 100° C. to about 350° C., more suitably from about 130° C. to about 240° C., and a pressure ranging from about 1 bar to about 50 bar, and more suitably, 1.5 bar to about 10 bar. The gaseous phase of the hydrocracked product may include contaminants, such as hydrogen sulfide ($H_2S$) and ammonia ($NH_3$), that are withdrawn from the gas-liquid separator as contaminated hydrogen-containing gas. In preferred embodiments, at least 50% of $NH_3$ and $H_2S$ present in the hydrocracked product that enters the gas-liquid separator is removed. Preferably, at least 80%, more preferably at least 90%, and most preferably at least 95% of the $NH_3$ and $H_2S$ present in the hydrocracked product is removed. Additionally, other impurities and contaminants such as methane ($CH_4$), ethane ($C_2H_6$), liquefied petroleum gas (LPG), naphtha, and gas oil can be removed at step (d), along with the $NH_3$ and $H_2S$.

The separated liquid phase of the hydrocracked product flows into any suitable distillation unit, preferably a vacuum distillation unit or vacuum tower, to be separated into fractions, for example, lighter hydrocracker products and a heavy oil stream. The lighter hydrocracker products include light and middle distillates with lower boiling point temperature ranging from 140 to 410° C. The light and middle distillates can include naphtha, which contains hydrocarbons boiling above about 100° C. to less than about 130° C., kerosene, which contains hydrocarbons boiling above about 130° C. to less than about 290° C., and diesel, which contains hydrocarbons boiling above about 290° C. to less than about 380° C.

Preferably, the heavy oil stream comprises hydrotreated/hydrocracked DAO, i.e., hydrowax. Hydrowax is a suitable feedstock used during dewaxing or other hydroprocessing techniques carried out during heavy base oil production. The hydrowax fractionated and recovered at step (d) is a liquid product with a kinetic viscosity in the range of 4.0 to 20 cSt, a viscosity index of at least 120, and a nitrogen content in an amount ranging from at least 0.01 to 20 ppm and a sulfur content in an amount ranging from at least 0.05 to 100 ppm, along with a boiling point ranging from about 330° C. to about 700° C.

In other embodiments, different and/or additional distillation and separation systems can be implemented including atmospheric distillation units, strippers, fractionators, or flash separators based on the desired level of separation and process conditions, among other factors.

Catalytic Dewaxing/Hydrofinishing

The hydrowax recovered at step (d) is used as feedstock during catalytic dewaxing to further produce the inventive base oil product. However, the recovered hydrowax may still contain waxy compounds (e.g., haze precursors, normal paraffins, iso-paraffins, etc.), aromatics, and other contaminants. Hydrowax comprising such waxy compounds and aromatics, when used as feed, often produces a base oil product comprising high pour and cloud points and a visually hazy appearance. Such a base oil product is often unsuitable for use and storage in low temperature conditions due to the formation of solid waxy crystals formed therein.

In the embodiments, the hydrowax is catalytically dewaxed in the presence of a unique mixture of noble metal-based catalysts to reduce and/or remove any remaining waxy compounds from the hydrowax during catalytic dewaxing at step (e). The mixture of noble metal-based catalysts described herein selectively removes and/or converts the waxy compounds of the hydrowax into a dewaxed product comprising a decreased pour point and cloud point.

At step (e), the hydrowax is contacted with hydrogen, in the presence of noble metal-based catalyst composition contained within a reactor, for example, a hydrofinishing/isomerization dewaxing reactor. The noble metal-based catalyst composition includes both dewaxing catalysts and hydrofinishing catalysts to remove the remaining haze precursors, other wax compounds, and aromatics.

Preferably, the dewaxing catalysts comprises a graduated mixture of noble metal isomerization dewaxing catalysts ("graduated mixture"), which are comprised of a ZSM-12 zeolite based catalyst ("ZSM-12"), a modified ZSM-12 zeolite based catalyst ("modified ZSM-12"), and a EU-2 and/or ZSM-48 zeolite based catalyst ("EU-2 and/or ZSM-48"). The ZSM-12 and the modified ZSM-12 have similar characteristics and thus, the description provided herein is descriptive of both catalysts. Modification of a catalyst is the process of mitigating the harmful effects of catalyst contamination (e.g., oxygen, water vapor, metals, etc.) without a substantial reduction in catalyst activity or selectivity. The modification method includes contacting the catalyst and/or a surface of the catalyst with the contaminant so that the contaminant is adsorbed by the catalyst and later released from the catalyst. Accordingly, the ZSM-12, unlike the modified ZSM-12, is not subjected to a modification process.

As described herein, the graduated mixture is defined to include a concentration gradient, i.e., non-uniform concentration or gradual difference in concentration of each catalysts, through the catalyst bed(s). The phrase "through the catalysts bed(s)" is defined to include moving from the inlet to the outlet of a catalyst bed. The concentration gradient of the embodiments can be achieved within a single catalyst bed, separate catalyst beds, separate reactors, or multiple reactors.

As a first example, within a single catalyst bed, the concentration of the ZSM-12 decreases and the concentrations of the modified ZSM-12 and EU-2 and/or ZSM-48 increase through the catalyst bed in either a linear or non-linear fashion. In this regard, the concentration of the ZSM-12 is highest at the inlet or inlet region of the catalyst bed so there is a linear or non-linear decrease in the concentration of the ZSM-12 from the inlet to the outlet through the catalyst bed. Moreover, the concentration of the modified ZSM-12 and EU-2 and/or ZSM-48 is highest at the outlet or outlet region of the catalyst bed so there is a linear or non-linear increase in the concentration of the modified ZSM-12 and EU-2 and/or ZSM-48 from the inlet to the outlet through the catalyst bed. In a top-down flow reactor, for instance, the inlet will be in the upper region of the catalyst bed which first comes into contact with the hydrowax and the outlet will be the lower region or bottom of the catalyst bed.

As a second example, within separate catalyst beds, in separate reactors or multiple reactors, the concentration of the ZSM-12 decreases and the concentration of modified ZSM-12 and EU-2 and/or ZSM-48 increases in a non-linear fashion when moving from one catalyst bed to the next catalyst bed(s) or reactor(s).

As a third example, a catalyst bed(s) can include two or more separate regions where the regions are in a stacked configuration. Each region in the catalyst bed comprising a mixture of the ZSM-12, modified ZSM-12, and EU-2 and/or ZSM-48, such that the total of the regions taken together define a gradient decreasing in the concentration of the ZSM-12 and increasing in the concentration of the modified ZSM-12 and EU-2 and/or ZSM-48 in a step-wise, non-linear, fashion from one region to the next region through the catalyst bed.

The previous examples are just a few of the various catalysts configurations found within the catalyst bed(s) and should not be interpreted, or otherwise used, as limiting the scope of the present invention. For instance, one skilled in the art may choose to have the concentration of the modified ZSM-12 highest at the inlet and the concentration of the ZSM-12 and EU-2 and/or ZSM-48 highest at the outlet. The chosen configuration for the catalysts may depend on the varied characteristics related to the process, for example, the characteristics of the DAO feed, the hydrowax, and the nature of the linear or non-linear concentration gradient desired to produce the haze-free at 0° C. heavy base oil, among other considerations.

Several gradient mixtures, in varying ratios of ZSM-12 to modified ZSM-12 to EU-2 and/or ZSM-48, may be prepared. The chosen graduated mixture is then loaded into a catalyst bed(s) to achieve the desired concentration gradient for each of the ZSM-12, modified ZSM-12, and EU-2 and/or ZSM-48 catalysts. It has been surprisingly found that higher base oil yields are obtained using the graduated mixture, as compared to using a non-gradient mixture (i.e., constant concentration of selected catalysts) through the catalyst bed(s).

The SAR of both the ZSM-12 and the modified ZSM-12 zeolite based catalysts is sufficiently high so as to exhibit exemplary catalytic properties of high activity while providing for a high yield of heavy lubricating base oil. In the embodiments, the ZSM-12 and the modified ZSM-12 have a SAR that is at least 50:1. Preferably, the SAR is greater than 60:1, or greater than 70:1, or greater than 75:1. An upper limit to the SAR of the ZSM-12 and the modified ZSM-12 is preferably at most 250:1, more specifically, the upper limit is a 200:1, and more preferably less than 150:1, in particular less than 110:1. If the SAR of an as-synthesized ZSM-12 is too low, it may further dealuminated using methods known in the art to provide a dealuminated ZSM-12 having the desired SAR.

The content of the ZSM-12 and the modified ZSM-12 should be at least 10 wt % and at most 70 wt % of the total weight of the graduated mixture.

The binder content of the ZSM-12 and the modified ZSM-12 can be in the range of from at least 30 wt % and no more than 90 wt % of the total weight of the graduated mixture. It is preferred that the binder content for the ZSM-12 and the modified ZSM-12 be at most 60 wt %, more preferred, at most 50 wt %, and more particular at most 40 wt % of the graduated mixture. It is further preferred for the binder content for the ZSM-12 and the modified ZSM-12 be at least 15 wt %, and more preferred, at least 20 wt % of the total weight of the graduated mixture. Moreover, it is preferred that neither the ZSM-12 nor the modified ZSM-12 contain any additional zeolites therein.

The EU-2 and/or ZSM-48 of the graduated mixture can include a refractory oxide binder essentially free of alumina. The SAR of the EU-2 and/or ZSM-48 preferably is at least 60, more preferably at least 70, more specifically at least 80, most preferably at least 90. The SAR of the EU-2 and/or ZSM-48 preferably is at most 300, more specifically at most 250, more specifically at most 200, most specifically at most 150.

The EU-2 and/or ZSM-48 preferably comprises at most 70 wt % of the graduated mixture, more specifically at most 65 wt %, more specifically at most 60 wt %, most preferably at most 55 wt %. Further, it is preferred that the amount of the EU-2/ZSM-48 is at least 15 wt %, more specifically at least 20 wt %, more specifically at least 25 wt %, most specifically at least 30 wt %.

Optionally, an additionally zeolite may be present in the EU-2 and/or ZSM-48, preferably, in an amount of at most 50 wt %, based on the total amount of EU-2 and/or ZSM-48 that is present in the total weight of the graduated mixture.

The binder content of the EU-2 and/or ZSM-48 can be in the range of from at least 30 wt % but no more than 85 wt % of the total weight of the graduated mixture. In the present invention, the reference to binders includes refractory oxide binders. Examples of refractory oxide binder materials are alumina, silica, zirconia, titanium dioxide, germanium dioxide, boria, and mixtures of two or more (e.g., silica-zirconia and silica-titania). Preferred binders are titania, zirconia and/or silica, where silica is the preferred binder of the graduated mixture.

In the embodiments, the noble metal component of the ZSM-12, the modified ZSM-12, and the EU-2 and/or ZSM-48 is preferably selected from the group of noble metals consisting of palladium and platinum. The preferred noble metal, however, is platinum.

The noble metal content for each catalyst of the graduated mixture may be in the range of upwardly of about 3 wt % based on the noble metal as an element, regardless of its actual form, and the total weight of the graduated mixture. It is preferred that the concentration of the noble metal component present in the graduated mixture be in the range of from 0.1 wt % to 3 wt %. More preferably, the noble metal component concentration ranges from 0.2 wt % to 2 wt %, and, most preferably, ranges from 0.3 wt % to 1 wt %.

The graduated mixture of the present invention is highly suitable for dewaxing hydrocarbon feedstocks, such as the hydrowax, to increase removal of waxy compounds that form wax crystals and thus, a visual haze in a base oil product. Accordingly, the system can be used in any conventional line-up comprising a section for dewaxing of hydrocarbon feedstocks, such as the hydrowax.

As previously stated, the noble metal-based catalyst composition of the hydrofinishing/isomerization dewaxing reactor can include hydrofinishing catalysts to remove and/or reduce the aromatics content. Preferably, the hydrofinishing catalyst is a noble metal aromatics hydrogenation catalyst which includes at least one noble metal component incorporated onto a support carrier comprised of zirconia and another inorganic oxide component. Preferable, the noble metal aromatics hydrogenation catalyst includes from 0.01 to 5 wt % of a noble metal selected from platinum, palladium, and a combination thereof, from 1 to 30 wt % zirconia, and from 60 to 99 wt % inorganic oxide selected from the group consisting of silica, alumina, and silica-alumina. A commercially available hydrofinishing catalyst is disclosed in U.S. Pat. No. 7,737,074, which is incorporated by reference herein.

The zirconium and inorganic oxide made up the support carrier. In particular, the zirconia and inorganic oxide are co-mulled to form a mixture that is later formed into an agglomerate particle that is dried and calcined to further form a calcined particle. The calcined particle is suitable for use as the support carrier for the noble metal aromatics hydrogenation catalyst.

The zirconium compound used in the support carrier may be selected from the group consisting of oxides, nitrates, silicates, carbonates, acetates, chlorides, hydroxides, and hydrates of zirconium. Specific examples of possible suitable zirconium compounds to be co-mulled with the inorganic oxide include zirconyl chloride (ZrOC1.8HO); zirconyl hydroxide (ZrO(OH)); zirconyl sulfate (ZrO(SO); sodium zirconyl sulfate (ZrO(SO)·NaSO); zirconyl carbonate (ZrO(CO)); ammonium zirconyl carbonate ((NH4)2rO (CO)); zirconyl nitrate (ZrO(NO)); zirconyl acetate (ZrO (CHO)) ammonium Zirconyl acetate ((NH4)2rO(CHO)); zirconyl phosphate (ZrO(HPO)); zirconium tetrachloride (ZrOl); zirconium silicate (ZrSiO); and zirconium oxide (ZrO). The preferred zirconium compounds include ammonium zirconyl carbonate and zirconyl acetate.

The inorganic oxide material used in the support carrier may be selected from the group of inorganic oxides consisting of silica, alumina, silica-alumina and any combination of two or more thereof. The preferred inorganic material to be combined with the zirconium compound is selected from either silica or alumina, or a combination of both.

When the support carrier contains both silica and alumina in relative amounts such that the molar ratio of SAR is in the range of from 1:10 to 10:1, the support carrier contains a zirconium content, as an element, in the amount in the range of from 0.5 to 20 wt %, preferably, from 1 to 15 wt %, and, most preferably, from 2 to 10 wt % with the weight percent being based on the total weight of the support carrier and calculated assuming the zirconium is metal.

When the support carrier has a SAR of greater than 10:1, including when the support carrier has a substantial absence of alumina or only silica in combination with zirconia, the support carrier is to have a zirconium content, as an element, in the amount in the range of from 3 to 30 wt %, preferably, from 5 to 25 wt %, and most preferably, from 7 to 20 wt % with the weight percent being based on the total weight of the support carrier and calculated assuming the zirconium is metal.

The surface area of the noble metal aromatics hydrogenation catalyst is, in general, in the range of from 200 to 500 $m^2$/gm, preferably, from 250 to 450 $m^2$/gm, and, more preferably, from 300 to 400 $m^2$/gm. The pore volume of the noble metal aromatics hydrogenation catalyst as determined by using standard mercury porosimetry methodology is generally in the range of from 0.7 to 1.3 ml/gm, and the median pore diameter of the noble metal aromatics hydrogenation catalyst is in the range of from 50 Å to 250 Å.

The preferred noble metal aromatics hydrogenation catalyst includes both a platinum component and a palladium noble metal component with a weight ratio of elemental palladium-to-platinum in the range of from 1:10 to 10:1, preferably, from 1:2 to 5:1, and, most preferably, from 1:1 to 3:1. Accordingly, the noble metal incorporated into the support carrier should provide a catalyst composition with a noble metal content ranging from 0.01 to 5 wt % for each of the noble metals with the weight percent being based on the total weight of the final catalyst composition and calculated as elemental metal. The preferred noble metal content for each noble metal component is in the range of from 0.1 to 4 wt. %, and, most preferred, from 0.2 to 3 wt. %.

The noble metal-based catalyst composition of the hydrofinishing/isomerization dewaxing reactor comprising the graduated mixture and the noble metal aromatics hydrogenation catalyst can enhance end-product performance and quality by removing haze precursors, other wax compounds, and aromatics while improving yields during catalytic dewaxing. In particular, the dewaxed product produced at step (e) includes a pour point that is preferably at least 40° C., and more preferably at least 60° C., lower than the pour point of the DAO feed and the hydrowax entering the hydrofinishing/isomerization dewaxing reactor.

In the preferred embodiments, the graduated mixture and the noble metal aromatics hydrogenation catalyst can be located in the same bed but in separate layers, in separate beds, or each in multiple beds or within the same reactor, separate reactors, or each in multiple reactors. Additionally, the noble metal aromatics hydrogenation catalyst can be loaded before or after the graduated mixture is loaded into the hydrofinishing/isomerization dewaxing reactor.

Catalytic dewaxing conditions are known in the art and typically involve reaction temperatures in the range of from 200-500° C., suitably from 250-400° C., reaction pressures in the range of from 10-200 bar, suitably from 15-100 bar, more suitably from 15-65 bar, and a weight hourly space velocities (WHSV) in the range of from 0.2-10 $hr^{-1}$, suitably from 0.2-5 $hr^{-1}$, more suitably from 0.5-3 $hr^{-1}$. Additionally, the catalytic dewaxing conditions can include a weighted average bed temperature (WABT) in the range of from 320-370° C. and a gas to oil ratio in the range of 500-1500 Nl/kg.

Hydrofinishing

The dewaxed product is hydrofinished at step (f) in the presence of a hydrofinishing catalyst to produce a hydrofinished product. The hydrofinishing catalyst is preferably a noble metal aromatics hydrogenation catalyst as previously described with respect to the hydrofinishing catalyst used at step (e). The hydrofinishing process is well-known in the art and includes the removal of mono-aromatic and polycyclic aromatics, among other aromatic compounds, from the dewaxed product to assure end-product stability, such as oxidation stability.

Generally, the hydrofinishing process is performed under the conditions of a reaction temperature range from about 125 to about 390° C., a reaction pressure range from about 70 to about 200 bar, a weighted average bed temperature (WABT) in the range of from 220-270° C., a gas to oil ratio in the range of 500-1500 Nl/kg, and a weight hourly space velocity (WHSV) in the range of from 0.3-3.0 $hr^{-1}$. If possible, the severity of the hydrofinishing reaction should be kept in a low range as increases in the reaction conditions can contribute to an increasingly lowered viscosity for the hazy-free at 0° C. heavy base oil composition, thus, resulting in lower heavy oil yields.

Distillation System II

The hydrofinished product produced at step (f) passes to a distillation unit at step (g) and is fractionated by conventional methods, such as by vacuum distillation under atmospheric or reduced pressure. Similar to the previous distillation system at step (d), the hydrofinished product can initially pass to a gas-liquid separator before flowing into the distillation unit at step (g) to be fractionated into lighter products and a heavy oil stream.

Any suitable vacuum distillation unit or vacuum tower known to those skilled in the art may be used to distill and separate the hydrofinished product into fractions, including light distillate fuel products, middle distillate fuel products, and a heavy base oil composition. The fractionated light distillate fuel products can include a viscosity ranging from 2-3 cSt at 100° C. with a boiling point less than about 390° C. and the fractionated middle distillate fuel products can include a viscosity ranging from 4.5-7.0 cSt at 100° C. with a boiling point ranging from 390-510° C. The heavy base oil composition is a haze-free at 0° C. heavy base oil with improved cold flow properties.

Recovery of Group II/III Heavy Base Oil

At step (h), the fractionated haze-free at 0° C. heavy base oil is recovered. The combination of the process steps, in the presence of the aforementioned catalyst compositions, produces the haze-free at 0° C. heavy base oil comprised of reduced pour and cloud points, low contaminant content, and increased viscosity index and kinetic viscosity. In particular, the haze-free at 0° C. heavy base oil is a Group II/III heavy base oil that suitably contains sulfur in an amount less than 5 ppm, preferably less than 1 ppmw, and contains nitrogen in an amount less than 5 ppm, preferably less than 1 ppm. The recovered hazy-free at 0° C. heavy base oil composition includes a kinetic viscosity ranging from 15 to 21 cSt at 100° C., a viscosity index ranging from 95 to 119 when prepared as a Group II base oil and a viscosity index above 120 when prepared as a Group III base oil, a pour point of less than −12° C., a cloud point of less than −18° C., and a total aromatics content of 2 wt % or less with a total saturates content is at least 98 wt %. More preferably, the recovered hazy-free at 0° C. heavy base oil composition includes a kinetic viscosity ranging from 19 to 20 cSt at 100° C., a viscosity index ranging from 95 to 119 when prepared as a Group II base oil and a viscosity index above 120 when prepared as a Group III base oil, a pour point of less than −24° C., a cloud point of less than −21° C., and a total aromatics content of 1 wt % or less with a total saturates content is at least 99 wt %.

A base oil product may contain a sufficient amount of haze precursors even after carrying out hydroprocessing steps as known to those in the art. In this case, wax crystals (e.g., solid hydrocarbon crystals) often form in the base oil when subjected to low temperatures and/or upon storage to create an undesirable hazy appearance. The degree of wax formation is characterized by cold flow properties, such as the pour point and the cloud point, and is indicative of a base oil's utility for certain applications at the low temperatures. The pour point is the temperature at which an oil begins to flow and the cloud point refers to the temperature at which the oil begins to cloud due to the formation of wax crystals.

However, the haze-free at 0° C. heavy base oil and the process of producing thereof supports reduced wax and haze formation due to lower pour and cloud points, in addition to, overall improved performance over conventional heavy base oil products. As an indicator of improved cold flow properties, the haze-free at 0° C. heavy base oil is subjected to a wax cloudiness test. The test is a pass/fail determination used to determine whether the recovered haze-free at 0° C. heavy base oil sustains its hazy-free appearance when stored at low temperatures and in an unagitated state (i.e., without disturbance) during an extended test period. In particular, the test is carried out during a test period of at least 5 hours, preferably at least 7 hours, at a temperature of 0° C. without disturbance or agitation, for example, unstirred. It is surprisingly found that the inventive haze-free at 0° C. heavy base oil failed to form any wax crystals when subjected to the wax cloudiness test and thus, sustains a hazy-free appearance when stored undisturbed at 0° C. for an extended period of time, for example, 5 hours, preferably 7 hours.

Accordingly, the present embodiments provide an improvement over known base oils and methods of producing by subjecting a DAO feed to a sequence of steps in the presence of unique catalyst compositions to produce a haze-free at 0° C. heavy base oil with reduced pour and cloud points. As shown by its ability to pass the wax cloudiness test, the haze-free at 0° C. heavy base oil fails to form solid wax compounds when subjected to lower temperatures. This improvement in cold flow properties exhibited by the inventive hazy-free at 0° C. heavy base oil makes it a desirable option, over conventional base oils, for use during heavy duty, cold temperature applications.

In addition to improved cold flow properties, the inventive process carried out in the presence of the catalyst compositions further provides a haze-free at 0° C. heavy base oil comprised of low contaminant and aromatics contents, lending to overall product stability. The inventive haze-free at 0° C. heavy base oil further comprises additionally advantages over conventional heavy base oils. It is surprisingly found that the process embodiments produced a high ratio of the haze-free at 0° C. heavy base oil over light base oils to provide a total product yield of least 99.8 wt %. Additionally, the haze-free at 0° C. heavy base oil includes a saybolt color of +20 or greater, preferably +24 or greater, more preferably +26 or greater. The saybolt color referred herein denotes the value measured in accordance with JIS K 2580 "Petroleum product-color test method-saybolt color test method" and includes the objective of removing substances inhibiting oxidation stability.

The FIGURE illustrates an example embodiment of a flow process for producing a haze-free at 0° C. heavy base oil from a deasphalted (DAO) feed. A pure DAO feed flows via line 102 into a pre-treating unit 104. Optionally, the feed can include a blend of the DAO, vacuum gas oil (VGO), and a fraction of hydrowax, in any combination thereof. The pre-treating unit 104 may include at least two commercially available catalyst beds, including, a hydrodemetallization catalyst and a hydrotreating catalyst to remove nitrogen, sulfur, and aromatic compounds, among other impurities. A hydrotreated product is drawn from the pre-treating unit 104 via line 106 to flow into a hydrocracker unit 108. The hydrotreated product is subjected to suitable hydrocracking conditions so as to crack at least a portion of the heavy hydrocarbons and haze precursors within the DAO feed into lower boiling hydrocarbons so as to produce a hydrocracked product. The hydrocracker unit 108 may contain hydrotreating and hydrocracking catalysts, for example, metal based hydrodenitrogenation catalysts, hydrodesulfurization catalysts, and hydrocracking catalysts.

The hydrocracked product passes from the hydrocracker unit 108 through line 110 into a first vacuum distillation unit 112 to be distilled and separated into various fractions. Residual products, including light distillates and middle distillates, are collected separately via line 114 and line 116, respectively, and are removed from the first vacuum distillation unit 112. The residual products may include at least one of ammonia ($NH_3$), hydrogen sulfide ($H_2S$), methane ($CH_4$), ethane ($C_2H_6$), liquefied petroleum gas (LPG), naphtha, and gas oil, among other contaminants.

A heavy oil stream, a hydrowax, is separately collected via line 120 to flow into a hydrofinishing/isomerization dewaxing unit 122. In some embodiments, part of the hydrowax via line 118 can be recycled to the hydrocracking unit 108 as a feedstock to increase the yield of middle distillates including kerosene and diesel products, such as an ultra-low-sulfur diesel fuel. In other embodiments, a portion of the middle distillates via line 116 may mix with the hydrowax via line 120 to flow into the hydrofinishing/isomerization dewaxing unit 122.

The hydrofinishing/isomerization dewaxing unit 122 is charged with a noble metal-based catalyst system made of, for example, an aromatics hydrogenation catalyst and a graduated mixture formulated to produce heavy base stock oils with improved cold flow properties. A dewaxed product is produced to flow from the hydrofinishing/isomerization dewaxing unit 122 flows via line 124 into a second hydrofinishing unit 126. The second hydrofinishing unit is charged with a hydrofinishing catalyst, for example, the aromatics hydrogenation catalyst used in unit 122. A hydrofinished product is passed via line 128 into a second vacuum distillation unit 130 to be fractionated into various base oils according to desired characteristics, such as, use and viscosity grade. In the present embodiments, the hydrofinished product is fractionated to provide a haze-free at 0° C. heavy base oil 132. Additional fractions from the hydrofinished product include a light distillate fuel product 134 with a viscosity ranging from 2 to 3 cSt at 100° C. with a boiling point of less than 380° C. and a middle distillate fuel product 136 with a viscosity ranging from 4.5 to 7.0 cSt at 100° C. with a boiling point ranging between 380° C. to 600° C.

The following examples are intended to illustrate the improved properties and capabilities as presented by the inventive embodiments.

Example 1

This Example 1 describes a DAO feed processed by the present process embodiment to produce the inventive base oil composition. The composition of the DAO feed used in each of the experiments is shown in Table 1.

TABLE 1

Composition of DAO Feedstock

| Components | Unit | Values |
|---|---|---|
| Specific gravity | 70/4° C. | 0.8962 |
| Refractive Index | nD70 | 1.5010 |
| Sulphur Content | % w | 2.63 |
| Nitrogen Content | ppmw | 917 |
| Hydrogen content | % w | 12.33 |
| Kinetic Viscosities At 80° C. | cSt | 76.23 |
| Kinetic Viscosities At 120° C. | cSt | 19.59 |
| Color ASTM | | >8 |
| MCR content | % w | 1.68 |
| $C_5$ Asphaltenes content | % w | 0.08 |
| Nickel content | ppmw | 2.1 |
| Vanadium content | ppmw | 2.7 |
| Iron content | ppmw | 1.0 |
| Distillation | | TBP-GLC 750° C. |
| IBP (Initial Boiling Point) | ° C. | 233 |
| 2% | ° C. | 463 |
| 4% | ° C. | 479 |
| 6% | ° C. | 486 |
| 8% | ° C. | 495 |
| 10% | ° C. | 500 |
| 20% | ° C. | 521 |
| 30% | ° C. | 538 |
| 40% | ° C. | 553 |
| 50% | ° C. | 569 |
| 60% | ° C. | 586 |
| 70% | ° C. | 607 |
| 80% | ° C. | 636 |
| 90% | ° C. | 712 |
| 94% | ° C. | 750 |

TABLE 1-continued

| Composition of DAO Feedstock | | |
|---|---|---|
| Components | Unit | Values |
| Laboratory Solvent Dewaxing at | ° C. | −20 |
| Wax content | % w | 10.2 |
| Filter Oil Kinematic Viscosities | | |
| At 40° C. | cSt | 272.22 |
| At 100° C. | cSt | 17.16 |
| Viscosity Index | | 53.6 |
| Sulphur Content | % w | 2.93 |
| Basic Nitrogen Content | ppmw | 414 |
| Aromatics (UV method) | | |
| mono | Wof % | 4.23 |
| di | Wof % | 2.62 |
| poly | Wof % | 5.85 |

The DAO feedstock, as described in Table 1, was subjected to hydroprocessing techniques including hydrotreating and hydrocracking process steps during experimental testing. The DAO was initially hydrotreated over a hydrotreating catalyst system, including, at least one hydrodemetallization catalyst and at least one hydrotreating catalyst to produce a hydrotreated product. The hydrotreating catalyst comprised a support material loaded with catalytically active metal compounds, an amine compound, and a non-amine containing polar additive.

Thereafter, a hydrotreated product was hydrocracked in the presence of a combination of hydrotreating and hydrocracking catalysts configured in a suitable configuration for multi-stage processing. The hydrotreating catalysts are as previously described. The hydrocracking catalysts comprised a porous carrier including an amorphous binder and zeolite Y. The porous carrier was further impregnated with a hydrogenation component, suitably Group VIII (preferably, cobalt, nickel, iridium, platinum and/or palladium) and/or Group IVB (preferably molybdenum and/or tungsten) catalytically active metals.

After hydrotreating and hydrocracking, a hydroprocessed product (i.e., a hydrocracked product) was generated containing a pour point of +27° C., 1.4 ppm nitrogen, and 10 ppm sulphur. The operating conditions and main outcome of the hydroprocessing step are indicated in Table 2.

TABLE 2

| Production of a Hydroprocessed Product (as per the invention) | | |
|---|---|---|
| Processing Conditions | Unit | Hydroprocessed Product (per Invention) |
| Inlet pressure | bar g | 150 |
| Reactor temperature, WABT | ° C. | 390 |
| WHSV | $T/m^3 \cdot h^{-1}$ | 1.0 |
| Yield Structure | | |
| $C_1$-$C_4$ | % wof | 0.21 |
| $NH_3$ | % wof | 0.15 |
| $H_2S$ | % wof | 2.82 |
| $H_2O$ | % wof | 0.34 |
| Total Liquid Product | % wof | 97.55 |
| 370° C.+ | % wof | 65.79 |
| Hydrogen consumption | % wof | 2.06 |
| Product Analysis | | |
| Nitrogen | ppmw | 1.4 |
| Sulphur | ppmw | 10 |
| $Vk_{120}$ | cSt | 12.25 |
| Viscosity Index | | 133 |
| Pour Point | ° C. | +27 |

TABLE 2-continued

| Production of a Hydroprocessed Product (as per the invention) | | |
|---|---|---|
| Processing Conditions | Unit | Hydroprocessed Product (per Invention) |
| 350° C.+ Distillation | | ASTM D2887 |
| IBP | ° C. | 332 |
| 5% | ° C. | 358 |
| 10% | ° C. | 378 |
| 30% | ° C. | 426 |
| 50% | ° C. | 493 |
| 70% | ° C. | 540 |
| 90% | ° C. | 599 |
| 95% | ° C. | 629 |
| FBP | ° C. | 705 |
| 460° C.+ content | % w | 61 |

Comparative Example 1

This Comparative Example 1 presents results of a comparative experimental testing using the same DAO feed as presented in Table 1. The DAO feed was hydroprocessed to a pour point of +51 and to similar nitrogen and sulphur levels, <2 ppmw and <30 ppmw, respectively, to match the typical requirements for second stage noble metal isomerization-dewaxing and hydrofinishing catalysts as per current practice. The hydrotreating catalyst comprised a high activity $NiMo/Al_2O_3$-type-II hydrotreating catalyst and a cracking bed of amorphous silica alumina catalyst. The operating conditions and main outcome of the hydroprocessing step of Comparative Example 1 are indicated in Table 3.

TABLE 3

| Production of a Hydroprocessed Effluent (as per current practice) | | |
|---|---|---|
| Processing Conditions | Unit | S & N Effluent (Per Current Practice) |
| Inlet pressure | bar g | 148 |
| Reactor temperature, WABT | ° C. | 395 |
| WHSV | $T/m^3 \cdot h^{-1}$ | 1.0 |
| Yield Structure | | |
| $C_1$-$C_4$ | % wof | 0.68 |
| $NH_3$ | % wof | 0.15 |
| $H_2S$ | % wof | 2.84 |
| $H_2O$ | % wof | 0.34 |
| Total Liquid Product | % wof | 97.71 |
| 370° C.+ | % wof | 72.70 |
| Hydrogen consumption | % wof | 1.88 |
| Product Analysis | | |
| Nitrogen | ppmw | 3 |
| Sulphur | ppmw | 12 |
| $Vk_{120}$ | cSt | 14.30 |
| Viscosity Index | | 128 |
| Pour Point | ° C. | +51 |
| 370° C.+ Distillation | | ASTM D2887 |
| IBP | ° C. | 372 |
| 5% | ° C. | 399 |
| 10% | ° C. | 421 |
| 30% | ° C. | 501 |
| 50% | ° C. | 563 |
| 70% | ° C. | 623 |
| 90% | ° C. | 695 |
| 95% | ° C. | 735 |
| FBP | ° C. | 750 |
| 460° C.+ content | % w | 65 |

A comparison of the results between the present invention (Table 2) and the current practice (Table 3) are provided in Table 4.

TABLE 4

| Summary After Hydroprocessing | | |
|---|---|---|
| Step: Hydroprocessing | As per invention (Table 2) | As per current practice (Table 3) |
| Catalyst | Multi-stage Processing including Hydrotreating + Hydrocracking Catalysts | High activity $NiMo/Al_2O_3$ + Cracking Bed of Amorphous Silica Alumina Catalyst |
| Nitrogen, ppmw | 1.4 | 3 |
| Sulphur, ppmw | 10 | 12 |
| 370° C.+ yield, % wof | 65.79 | 72.7 |
| 460° C.+, % | 61 | 65 |
| $Vk_{120}$, cSt | 12.25 | 14.30 |
| Viscosity Index | 133 | 128 |
| Pour Point, ° C. | +27 | +51 |

When comparing the results presented in Table 2 of the present invention with those of the current practice in Table 3, the inventive processes carried out in the presence of hydrotreating and hydrocracking catalysts produce a hydrocracked product with improved cold flow properties and reduced contaminant removal.

Example 2

The hydroprocessed product of Table 2 was fractionated to recover a hydrotreated/hydrocracked DAO, e.g., a hydrowax. This Example 2 presents results of experimental testing during catalytic dewaxing of the hydrowax over a noble metal-based catalyst composition to further remove waxy compounds and aromatics during the production of the inventive heavy base oil. The noble metal-based catalyst composition includes both dewaxing catalysts and hydrofinishing catalysts. The dewaxing catalysts comprised a graduated mixture of noble metal isomerization dewaxing catalysts. The hydrofinishing catalysts comprised noble metal aromatics hydrogenation catalysts.

After catalytic dewaxing, a catalytically dewaxed product was generated containing a pour point of −48° C. and a cloud point of −21° C. The operating conditions and main outcome of the catalytic dewaxing step are indicated in Table 5.

TABLE 5

| Production of a Catalytically Dewaxed Product (as per the invention) | | |
|---|---|---|
| Processing Conditions | Unit | Catalytically Dewaxing (per Invention) |
| Inlet pressure | bar g | 145 |
| Reactor temperature, WABT | ° C. | 338 |
| WHSV | $T/m^3 \cdot h^{-1}$ | 1.02 |
| Yield | | |
| Total Liquid Product | % wof | 95.0 |
| 370° C.+ | % wof | 75.0 |
| Product Analysis | | |
| $Vk_{100}$ | cSt | 10.30 |
| Viscosity Index | | 118 |
| Pour Point | ° C. | −48 |
| Cloud Point | ° C. | −21 |
| 370° C.+ Distillation | | ASTM D2887 |
| IBP | ° C. | 370 |
| 5% | ° C. | 398 |
| 10% | ° C. | 421 |
| 30% | ° C. | 488 |
| 50% | ° C. | 520 |
| 70% | ° C. | 556 |
| 90% | ° C. | 603 |

TABLE 5-continued

| Production of a Catalytically Dewaxed Product (as per the invention) | | |
|---|---|---|
| Processing Conditions | Unit | Catalytically Dewaxing (per Invention) |
| 95% | ° C. | 636 |
| FBP | ° C. | 666 |
| Heavy (18 cSt)/ Light base oil (5 cSt) | % w | 45/35 = 1.29 |

Comparative Example 2

This Comparative Example 2 presents results of comparative experimental testing after stripping of contaminants and light products (ASTM D2887 IBP=372° C.) of the hydroprocessed effluent described in Table 3. The hydroprocessed effluent was catalytically dewaxed on Shell commercial dewaxing catalyst system specifically developed for the dewaxing of deeply hydrotreated feedstocks for base oil II and III production. The operating conditions and main outcome of the catalytic dewaxing step of Comparative Example 2 are indicated in Table 6.

TABLE 6

| Production of a Catalytically Dewaxed Product (as per the current practice) | | |
|---|---|---|
| Processing Conditions | Unit | Dewaxing (per current practice) |
| Inlet pressure | bar g | 145 |
| Reactor temperature, WABT | ° C. | 345 |
| WHSV | $T/m^3 \cdot h^{-1}$ | 1.25 |
| Yield | | |
| Total Liquid Product | % wof | 99.2 |
| 370° C.+ | % wof | 78.0 |
| Product Analysis | | |
| $Vk_{100}$ | cSt | 8.81 |
| Viscosity Index | | 115 |
| Pour Point | ° C. | −27 |
| Cloud Point | ° C. | +9 |
| 370° C.+ Distillation | | ASTM D2887 |
| IBP | ° C. | 370 |
| 5% | ° C. | 400 |
| 10% | ° C. | 415 |
| 30% | ° C. | 454 |
| 50% | ° C. | 485 |
| 70% | ° C. | 517 |
| 90% | ° C. | 464 |
| 95% | ° C. | 590 |

TABLE 6-continued

| Production of a Catalytically Dewaxed Product (as per the current practice) | | |
|---|---|---|
| Processing Conditions | Unit | Dewaxing (per current practice) |
| FBP | ° C. | 642 |
| Heavy (18.0 cSt)/ Light base oil (5.5 cSt) | % w | 40/37 = 1.08 |

A comparison of the results between the present invention (Table 5) and the current practice (Table 6) are provided in Table 7.

TABLE 7

| Summary After Catalytic Dewaxing | | |
|---|---|---|
| Step Catalytic Dewaxing | As per Invention (Table 5) | As per Current Practice (Table 6) |
| Catalyst | Noble Metal-Based Catalyst Composition | Shell commercial dewaxing catalyst system |
| 370° C.+ yield, % wof (step 2) | 75.0 | 78.0 |
| $Vk_{100}$, cSt | 10.30 | 8.81 |
| Viscosity Index | 118 | 115 |
| Pour Point, ° C. | −48 | −27 |
| Cloud Point, ° C. | −21 | +9 |

When comparing the results presented in Table 5 of the present invention with those of the current practice in Table 6, the inventive processes carried out in the presence of the noble metal-based catalyst composition, including the graduated mixture of dewaxing catalysts, produced a catalytically dewaxed product with improved cold flow properties, including a pour point of −48° C. and a cloud point of −21° C. Conversely, during the current practice, the product produced comprised a higher pour point of −27° C. and a higher cloud point of +9° C.

Example 3

This Example 3 presents results of experimental testing during hydrofinishing of the catalytic dewaxing product, as described in Table 5. The catalytic dewaxing product is hydrofinished in the presence of a noble metal aromatics hydrogenation catalyst to remove mono-aromatic and polycyclic aromatics, among other aromatic compounds during the production of the inventive heavy base oil. After hydrofinishing, a hydrofinished product was generated comprising a pour point of −45° C. and a cloud point of −18° C., along with a reduced nitrogen and sulfur content of 1.0 ppmw and 3.5 ppmw, respectively. The operating conditions and main outcome of the hydrofinishing step to produce a hydrofinished product are indicated in Table 8.

TABLE 8

| Production of a Hydrofinished Product (as per the invention) | | |
|---|---|---|
| Processing Conditions | Unit | Hydrofinishing (per Invention) |
| Hydrogenation metal(s) | | Pt Pd |
| Outlet pressure | bar g | 140 |
| Reactor temperature, WABT | ° C. | 240 |
| WHSV | $T/m^3 \cdot h^{-1}$ | 0.8 |

TABLE 8-continued

| Production of a Hydrofinished Product (as per the invention) | | |
|---|---|---|
| Processing Conditions | Unit | Hydrofinishing (per Invention) |
| Yield | | |
| Total Liquid Product | % wof | 99.8 |
| 370° C.+ yield on 370° C. in feed to Step 3 | % wof | 99.5 |
| Product Analysis | | |
| Sulphur | ppmw | 3.5 |
| Nitrogen | ppmw | 1.0 |

TABLE 8-continued

| Production of a Hydrofinished Product (as per the invention) | | |
|---|---|---|
| Processing Conditions | Unit | Hydrofinishing (per Invention) |
| Saturates Content | % | >95 |
| $Vk_{100}$ | cSt | 10.02 |
| Viscosity Index | | 110 |
| Pour Point | ° C. | −45 |
| Cloud Point | ° C. | −18 |
| 370° C.+ Distillation | | ASTM D2887 |
| IBP | ° C. | 370 |
| 5% | ° C. | 398 |
| 10% | ° C. | 421 |
| 30% | ° C. | 488 |
| 50% | ° C. | 520 |
| 70% | ° C. | 556 |
| 90% | ° C. | 603 |
| 95% | ° C. | 636 |
| FBP | ° C. | 666 |
| Heavy (18 cSt)/ Light base oil (5 cSt) | %w | 45/35 = 1.29 |

Comparative Example 3

This Comparative Example 3 presents results of comparative experimental testing of a dewaxed product subjected to a hydrofinishing step using noble metal hydrofinishing catalyst (LN-5) from Criterion. The operating conditions and main outcome of the hydrofinishing step of Comparative Example 3 are indicated in Table 9.

TABLE 9

| Production of a Hydrofinished Product (as per current practice) | | |
|---|---|---|
| Processing Conditions | Unit | LN-5 (per current practice) |
| Hydrogenation metal(s) | | Pt Pd |
| Outlet pressure | bar g | 142 |
| Reactor temperature, WABT | ° C. | 250 |
| WHSV | $T/m^3 \cdot h^{-1}$ | 1.0 |
| Recycle gas rate | $Nm^3/T$ | 1500 |
| Yield | | |
| Total Liquid Product | % wof | 99.6 |
| 370° C.+ (Step 3) | % wof | 99.1 |
| Overal 370° C.+ (1 + 2 + 3) | % wof | 60.9 |
| Product Analysis | | |
| Sulphur | ppmw | <10 |
| Nitrogen | ppmw | <1 |
| Saturates Content | % | >98 |
| $Vk_{100}$ | cSt | 8.76 |
| Viscosity Index | | 107 |
| Pour Point | ° C. | −12 |
| Cloud Point | ° C. | +9 |
| 370° C.+ Distillation | | ASTM D2887 |
| IBP | ° C. | 369 |
| 5% | ° C. | 399 |
| 10% | ° C. | 415 |
| 30% | ° C. | 454 |
| 50% | ° C. | 485 |
| 70% | ° C. | 517 |
| 90% | ° C. | 464 |
| 95% | ° C. | 590 |
| FBP | ° C. | 641 |
| Heavy (18 cSt)/ Light base oil (5 cSt) | % w | 40/37 = 1.08 |

A comparison of the results between the present invention (Table 8) and the current practice (Table 9) are provided in Table 10.

TABLE 10

| Summary After Hydrofinishing | | |
|---|---|---|
| Step Hydrofinishing | As per Invention (Table 5) | As per Current Practice (Table 6) |
| Catalyst | Noble Metal Aromatics Hydrogenation Catalyst | LN-5 |
| Nitrogen, ppmw | 1.0 | <1 |
| Sulphur, ppmw | 3.5 | <10 |
| Saturates Content | >95% | >98% |
| Total Product Yield | 99.8 | 99.6 |
| $Vk_{100}$, cSt | 10.02 | 8.76 |
| Viscosity Index | 110 | 107 |
| Pour Point, ° C. | −45 | −12 |
| Cloud Point, ° C. | −18 | +9 |
| Wax Cloudiness Test | Pass | Fail |

When comparing the results presented in Table 8 of the present invention with those of the current practice in Table 9, the inventive processes carried out in the presence of the metal-based and noble metal-based catalysts with improved cold flow properties, including a pour point of −45° C. and a cloud point of −18° C., as provided for in Table 9. Conversely, during the current practice, the produced base oil comprised a higher pour point of −12° C. and a higher cloud point of +9° C., as compared to the inventive haze-free at 0° C. heavy base oil. Additionally, the haze-free at 0° C. heavy base oil passed the wax cloudiness test, as opposed to the conventionally produced base oil, which failed the test.

While the described process may be susceptible to various modifications and alternative forms, the exemplary embodiments discussed above have been shown only by way of example. It is to be understood that the inventive process is not intended to be limited to the particular embodiments disclosed herein. Moreover, reference throughout this specification to "one embodiment", "an embodiment", or similar language means that a particular feature, structure, or characteristic described in connection with the embodiment may be included in at least one embodiment of the present invention. Thus, the phrases one embodiment", "an embodiment", or similar language throughout the specification may, but do not necessarily, all refer to the same embodiment.

Although the present invention has been described with respect to specific details, it is not intended that such details should be regarded as limitations on the scope of the invention except to the extent that they are included by the accompanying claims.

That which is claimed is:

1. A process for producing a base oil composition, comprising:

(a) providing a deasphalted oil (DAO) feed;

(b) hydrotreating a portion of the DAO feed in the presence of hydrotreating catalysts to produce a hydrotreated product;

(c) hydrocracking the hydrotreated product in the presence of hydrocracking catalysts to produce a hydrocracked product;

(d) fractionating the hydrocracked product wherein at least one fraction comprises hydrowax;

(e) catalytically dewaxing the hydrowax in the presence of noble metal-based catalysts to produce a dewaxed product, wherein the noble metal-based catalysts comprise a graduated mixture comprising ZSM-12 and modified ZSM-12 zeolite based catalysts and EU-2 and/or ZSM-48 zeolite based catalysts;

(f) hydrofinishing the dewaxed product in the presence of hydrofinishing catalysts to produce a hydrofinished product;

(g) fractionating the hydrofinished product wherein at least one fraction comprises the base oil composition; and wherein the base oil composition is a hazy-free at 0° C. heavy base oil comprising: (a) a kinetic viscosity ranging from 15 to 21 cSt at 100° C., (b) a viscosity index of at least 95, (c) a pour point of less than −12° C., (d) a cloud point of less than −18° C., and (e) a total aromatics content of 2 wt % or less;

wherein the hazy-free at 0° C. heavy base oil maintains a hazy-free appearance when stored undisturbed at 0° C. during a test period; and wherein the hazy-free at 0° C. heavy base oil composition is a Group II/III base oil.

2. The process of claim 1, wherein the base oil composition is a hazy-free at 0° C. heavy base oil comprising: (a) a kinetic viscosity ranging from 19 to 20 cSt at 100° C., (b) a viscosity index ranging from 100 to 119 for the Group II base oil and at least 120 for the Group III base oil, (c) a pour point of less than −24° C., (d) a cloud point of less than −21° C., and (e) a total aromatics content of 1 wt % or less; and wherein the hazy-free at 0° C. heavy base oil maintains a hazy-free appearance when stored undisturbed at 0° C. during a test period.

3. The process of claim 1, wherein the base oil composition comprises a sulfur content below 5 ppm and a nitrogen content below 5 ppm.

4. The process of claim 1, wherein the base oil composition comprises a sulfur content below 1 ppm and a nitrogen content below 1 ppm.

5. The process of claim 1, wherein the base oil composition comprises a saturates content ranging from about 98 wt % to about 99.9%.

6. The process of claim 1, wherein the test period is at least 5 hours.

7. The process of claim 1, wherein the test period is at least 7 hours.

8. The process of claim 1, wherein the DAO feed comprises at least 50% by weight of hydrocarbons boiling above 450° C., at least 400 ppm of nitrogen, at least 0.5 wt % of sulfur, and a (nickel (Ni)+vanadium (V)) metal content ranging from 2-250 ppm.

9. The process of claim 1, wherein the DAO feed comprises more than 65% by weight of hydrocarbons boiling above 450° C.

10. The process of claim 1, wherein the DAO feed comprises at least one of a pure DAO or a blend of DAO and vacuum gas oil (VGO) and wherein the blend of DAO and VGO comprises a ratio of about 6:1 to about 1:6.

11. The process of claim 8, wherein the DAO feed comprises a blend of DAO, VGO, and part of the hydrowax, in any combination thereof.

12. The process of claim 1, wherein the hydrotreated product comprises nitrogen ranging from 0.1-30 ppm, sulfur ranging from 10-200 ppm, and a total uptake of at least 30% of the (Ni+V) metal content.

13. The process of claim 1, wherein the hydrocracking catalysts at step (c) comprise a zeolite component.

14. The process of claim 1, wherein the hydrocracking catalysts at step (c) comprise an additional zeolite component selected from zeolite beta, zeolite ZSM-5, or zeolite Y.

15. The process of claim 1, further comprising a bed of hydrotreating catalysts at step (c) to produce the hydrocracked product.

16. The process of claim 1, wherein the hydrocracking conditions of step (c) comprise a temperature in the range of from 250-500° C., a pressure in the range of from 35-250 bar, a weighted average bed temperature (WABT) in the range of from 350-420° C., a gas to oil ratio in the range of from 500-1500 Nl/kg, and a weight hourly space velocity in the range of from 0.2-10 $hr^{-1}$.

17. The process of claim 1, wherein the hydrowax at step (d) comprises a kinetic viscosity of at least 4.0 cSt at 100° C., a viscosity index of at least 120, a nitrogen content below 20 ppm, and a sulfur content below 100 ppm.

18. The process of claim 1, further comprising stripping residual products from the hydrocracked product at step (d), wherein the residual products comprise at least one of ammonia ($NH_3$), hydrogen sulfide ($H_2S$), methane ($CH_4$), ethane ($C_2H_6$), liquefied petroleum gas (LPG), naphtha, and gas oil.

19. The process of claim 1, wherein the noble metal-based catalysts of step (e) comprise the graduated mixture and noble metal aromatics hydrogenation catalysts.

20. The process of claim 1, wherein the catalytically dewaxing conditions of step (e) comprise a temperature in the range of from 200-500° C., a pressure in the range of from 10-200 bar, a weighted average bed temperature (WABT) in the range of from 320-370° C., a gas to oil ratio in the range of from 500-1500 Nl/kg, and a weight hourly space velocity (WHSC) in the range of from 0.2-10 $hr^{-1}$.

21. The process of claim 1, wherein the hydrofinishing conditions of step (f) comprise a temperature in the range of from 125-390° C., a pressure in the range of from 70-200 bar, a weighted average bed temperature (WABT) in the range of from 220-270° C., a gas to oil ratio in the range of from 500-1500 Nl/kg, and a weight hourly space velocity (WHSC) in the range of from 0.3-3.0 $hr^{-1}$.

22. The process of claim 1, wherein at least one of the hydrofinishing catalysts of step (f) is a noble metal aromatics hydrogenation catalyst.

23. A base oil composition, comprising:

(a) a kinetic viscosity ranging from 15 to 21 cSt at 100° C.;

(b) a viscosity index of at least 95;

(c) a pour point of less than −12° C.;

(d) a cloud point of less than −18° C.;

(e) a total aromatics content of 2 wt % or less comprising a mono-aromatic content and a polycyclic aromatic content; and wherein the base oil composition is a hazy-free at 0° C. heavy base oil that maintains a hazy-free appearance when stored undisturbed at 0° C. during a test period; and wherein the hazy-free at 0° C. heavy base oil composition is a Group II/III base oil.

24. The base oil composition of claim 23, further comprising:

(a) a kinetic viscosity ranging from 19 to 20 cSt at 100° C.;

(b) a viscosity index ranging from 100 to 119 for the Group II base oil and at least 120 for the Group III base oil;

(c) a pour point of less than −24° C.;

(d) a cloud point of less than −21° C.;

(e) a total aromatics content of 1 wt % or less, wherein the base oil composition is a hazy-free at 0° C. heavy base oil that maintains a hazy-free appearance when stored undisturbed at 0° C. during a test period.

25. The base oil composition of claim 23, wherein the test period is at least 5 hours.

26. The base oil composition of claim 23, wherein the test period is at least 7 hours.

27. The base oil composition of claim 23, further comprising a sulfur content below 5 ppm and a nitrogen content below 5 ppm.

28. The base oil composition of claim 23, further comprising a sulfur content below 1 ppm and a nitrogen content below 1 ppm.

29. The base oil composition of claim 23, further comprising a saturates content ranging from about 98 wt % to about 99.9%.

* * * * *